US008585433B2

(12) United States Patent
Honda

(10) Patent No.: US 8,585,433 B2
(45) Date of Patent: Nov. 19, 2013

(54) CONNECTOR CAPABLE OF REDUCING OCCURRENCE OF A CONTACT FAILURE

(75) Inventor: Yosuke Honda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/542,876

(22) Filed: Jul. 6, 2012

(65) Prior Publication Data

US 2013/0052858 A1 Feb. 28, 2013

(30) Foreign Application Priority Data

Aug. 31, 2011 (JP) ..... 2011-188242

(51) Int. Cl.
*H01R 12/00* (2006.01)

(52) U.S. Cl.
USPC ..... 439/499; 439/77

(58) Field of Classification Search
USPC ..... 439/67, 77, 492, 497, 499
See application file for complete search history.

(56) References Cited

U.S. PATENT DOCUMENTS 5,967,831 A * 10/1999 Yamada et al. ..... 439/496
7,025,626 B2 * 4/2006 Fuerst et al. ..... 439/496
7,258,567 B2 8/2007 Tanaka et al.
7,377,804 B2 * 5/2008 Lin ..... 439/499
7,559,772 B2 * 7/2009 Tsai ..... 439/67
8,052,464 B2 * 11/2011 Maruishi et al. ..... 439/496

FOREIGN PATENT DOCUMENTS

JP H05-045947 U 6/1993
JP 06-283236 10/1994
JP 2006-032250 A 2/2006

OTHER PUBLICATIONS

Korean Office Action dated Jun. 28, 2013 in Korean Application No. 2012-0082472 with English translation.

* cited by examiner

*Primary Examiner* — Khiem Nguyen
(74) *Attorney, Agent, or Firm* — Collard & Roe, P.C.

(57) ABSTRACT

For connecting a mating connector in a first direction, a connector has a base, a cover, and a plate-like or sheet-like flexible connection member sandwiched between the base and the cover. The connection member includes a first portion extending in the first direction, a second portion extending in a second direction crossing the first direction, a bent portion formed between the first portion and the second portion, and an ear portion provided on the first portion. The ear portion is near the bent portion and increases the size of the connection member in a third direction perpendicular to the first and the second directions. The cover has an actuator portion facing an edge of the ear portion in the first direction.

11 Claims, 18 Drawing Sheets

CONNECTOR CAPABLE OF REDUCING OCCURRENCE OF A CONTACT FAILURE

This application is based upon and claims the benefit of priority from Japanese Patent Application No. 2011-188242, filed on Aug. 31, 2011, the disclosure of which is incorporated herein in its entirety by reference.

TECHNICAL FIELD

The present invention relates to a connector using a plate-like or sheet-like flexible connection member.

BACKGROUND ART

There has heretofore been a plate-like or sheet-like connection member such as a flexible printed circuit (FPC) or a flexible flat cable (FFC). This type of connection members can be mated directly with a mating connection member. In order to facilitate a mating operation of such a connection member, as proposed in JP-A-H06-283236 (Patent Literature 1), a clip is attached to an end portion of an FFC so as to hold the end portion of the FFC in a bending state.

The technique disclosed in Patent Literature 1 will briefly be described with reference to FIG. 1.

In FIG. 1, a clip 2 is attached to an FFC 1 so as to hold an end portion 1*a* of the FFC 1 in a state in which the end portion 1*a* is bent substantially at a right angle. The clip 2 includes a first plate part 2*a*, a second plate part 2*b*, and left and right connection band parts 2*c* for connecting the first plate part 2*a* and the second plate part 2*b* to each other. The first plate part 2*a*, the second plate part 2*b*, and the connection band parts 2*c* are formed integrally with each other. The FFC 1 is inserted into a hole defined between the left and right connection band parts 2*c* and sandwiched between the first plate part 2*a* and the second plate part 2*b*. The end portion 1*a* of the FFC 1 has a tip exposed externally from the clip 2. Thus, the FFC 1 can be mated directly with a connector 3 by inserting the tip of the end portion 1*a* in an insertion slot 3*a* of the connector 3.

SUMMARY OF THE INVENTION

However, Patent Literature 1 does not pay any attention to a bending point of the FFC. Therefore, the accuracy of the bending point of the FFC is likely to be lowered. Accordingly, the length of an exposed part of the end portion of the FFC is likely to vary. Furthermore, the FFC is not exactly bent at a right angle even though the FFC is flexible. Therefore, unexpected deformation of the FFC is likely to be caused at a portion from the bending point to the tip of the FFC when the FFC is bent or mated with the connector. If the FFC suffers from variations of its bending point or deformation, then an effective contact length of the FFC being mated is shortened, so that a contact failure is likely to occur.

Furthermore, the tip of the FFC may collide directly with the mating connector during a mating operation in some cases. In such cases, the FFC is broken so that a contact failure occurs.

It is therefore an exemplary object of the present invention to provide a connector capable of reducing occurrence of a contact failure even in a case where a flexible connection member is used for connection with a mating connector.

Other objects of the present invention will become clear as the description proceeds.

According to an exemplary aspect of the present invention, there is provided a connector to be connected to a mating connector with being fitted into the mating connector in a first direction. The connector comprises a connection member which is of a plate-like or a sheet-like and has flexibility, a base, and a cover which is cooperated with the base to sandwich the connection member from both sides thereof. The connection member includes a first portion which extends in the first direction for being connected to the mating connector, a second portion which extends in a second direction crossing the first direction, a bent portion which is between the first portion and the second portion, and an ear portion which is provided on at least portion of the first portion to increase a size of the connection member in a third direction perpendicular to the first and the second directions, the at least portion being adjacent to the bent portion, the cover including an actuator portion which presses an edge of the ear portion in the first direction during an operation of mating the connector to the mating connector.

DESCRIPTION OF THE EMBODIMENT

A first embodiment of the present invention will be described below with reference to FIGS. 2A to 10B.

Figure 1:
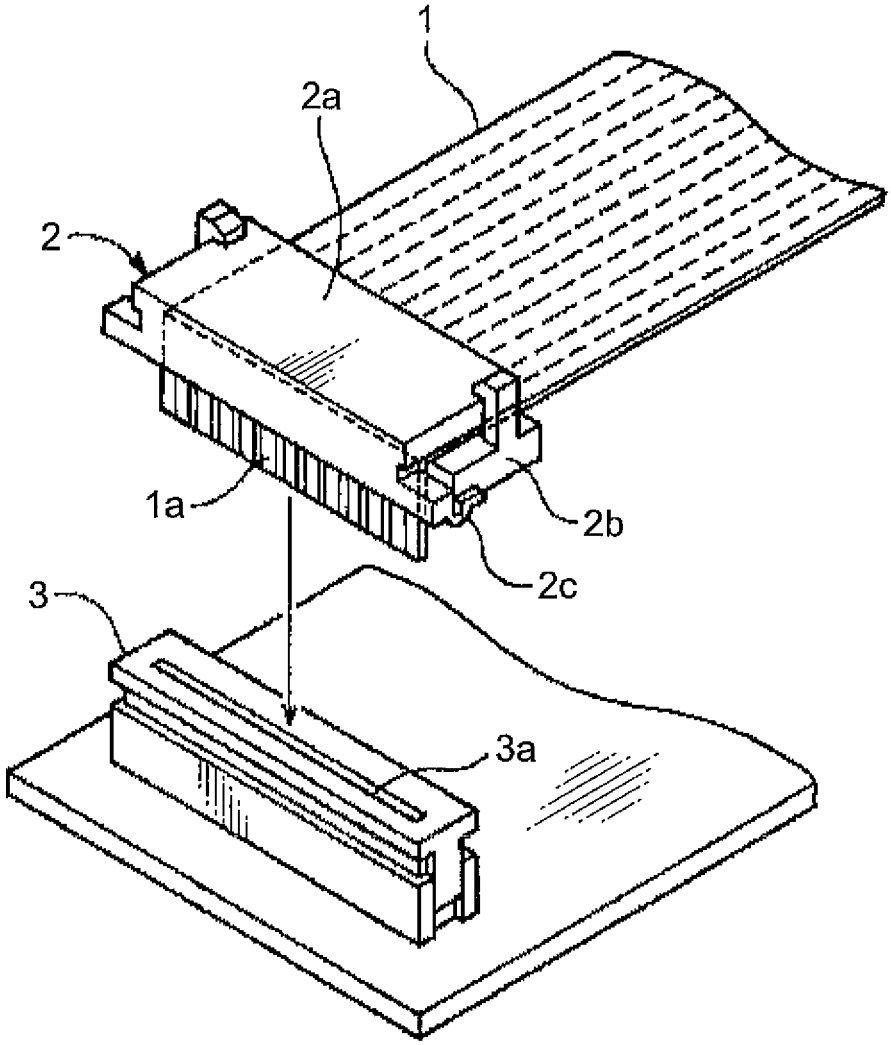
FIG. 1 PRIOR ART
FIG. 1 is a perspective view explanatory of a technique disclosed in JP-A 6-283236 (Patent Literature 1)
Figure 2A:
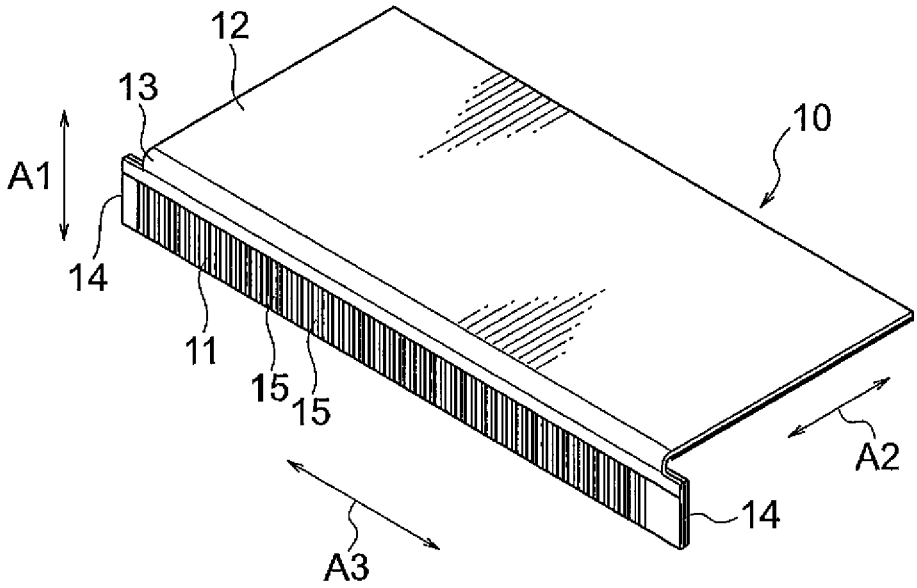
FIG. 2A is a perspective view showing an example of a plate-like or sheet-like flexible connection member.
Figure 2B:
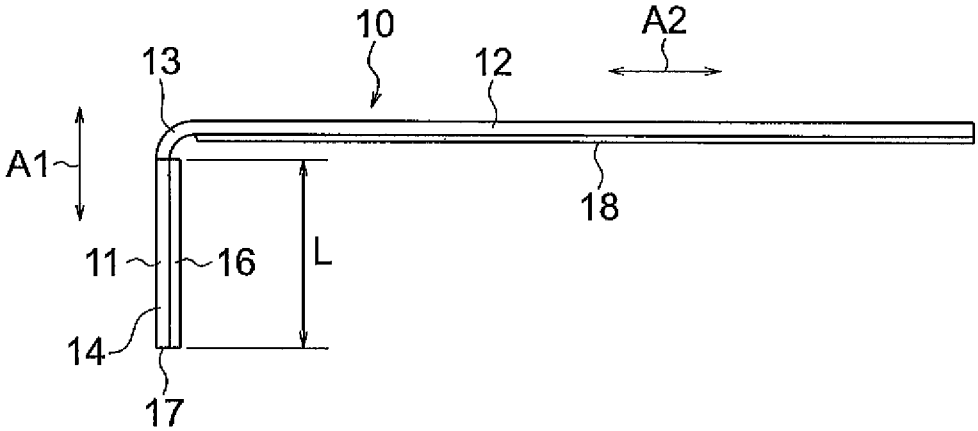
FIG. 2B is a side view of the connection member shown in FIG. 2A.

FIGS. 2A and 2B show an example of a plate-like or sheet-like flexible connection member 10 used in a connector according to a first embodiment of the present invention. The connection member 10 is formed of an FPC or an FFC. The connection member 10 includes a first portion 11 in the form of a plate, a second portion 12 in the form of a plate, and a bent portion 13 curved between the first portion 11 and the second portion 12. The first portion 11 extends along a first direction (mating direction) A1, in which the connector is mated with and connected to a mating connector. The second portion 12 extends in a second direction (longitudinal direction) A2 perpendicular to the first direction A1. Specifically, the connection member 10 is preformed such that a right angle is substantially formed by the first portion 11 and the second portion 12. As will be apparent from the following description, the first portion 11 relates to the effective contact length of the connector. Therefore, a tolerance of the size L of the first direction A1 needs to be reduced.

The connection member 10 includes a pair of ear portions 14 provided on the first portion 11. Those ear portions 14 increase the size of the connection member 10 in a third direction (width direction) A3 perpendicular to the first direction A1 and the second direction A2. In FIGS. 2A and 2B, the ear portions 14 extend along the width direction of the connection member 10 roughly from the entire first portion 11. Nevertheless, the ear portions 14 may be provided on only part of the first portion 11 that is located near the bent portion 13. In other words, the ear portions 14 should be provided on at least part of the first portion 11 that is located near the bent portion 13.

Since the ear portions 14 for increasing the size of the connection member 10 are provided on at least part of the first portion 11 that is located near the bent portion 13, the bent portion 13 can be formed by bending the connection member 10 while using the ear portions 14 as a base. Accordingly, the accuracy of a bending point of the connection member 10, i.e., the accuracy of a location of the bent portion 13, can be enhanced so that a certain effective contact length can readily be obtained. Specifically, a tolerance of the size L along the first direction A1 can be reduced with ease.

The connection member 10 has a large number of signal conductors 15 exposed on an outside surface of the first portion 11, i.e., a left side surface of the first portion 11 in FIG. 2B. Those signal conductors 15 constitute contact parts that are brought into contact with mating contact parts when the connector is mated with and connected to the mating connector. Those signal conductors 15 are arranged at a predetermined pitch along the third direction A3. Furthermore, the signal conductors 15 extend continuously from the first portion 11 through the bent portion 13 to the second portion 12.

Moreover, the connection member 10 has a reinforcement plate 16 attached to an inside surface of the first portion 11 including the ear portions 14. The reinforcement plate 16 has an insulating property. The reinforcement plate 16 is provided at least near an edge (free end) 17 of the first portion 11, which is opposite to the second portion 12 in the first direction A1. Therefore, the tip of the first portion 11 of the connection member 10 is reinforced with the reinforcement plate 16, so that it is unlikely to be bent. Accordingly, the first portion 11 is not deformed even if some external forces are applied to the first portion 11.

The second portion 12 has ground conductors 18 provided on an inside surface thereof, i.e., a lower surface thereof. In FIGS. 2A and 2B, the second portion 12 is illustrated as having a limited size in the second direction A2. In practice, however, the second portion 12 may extend longer rightward in FIG. 2B.

Figure 3:
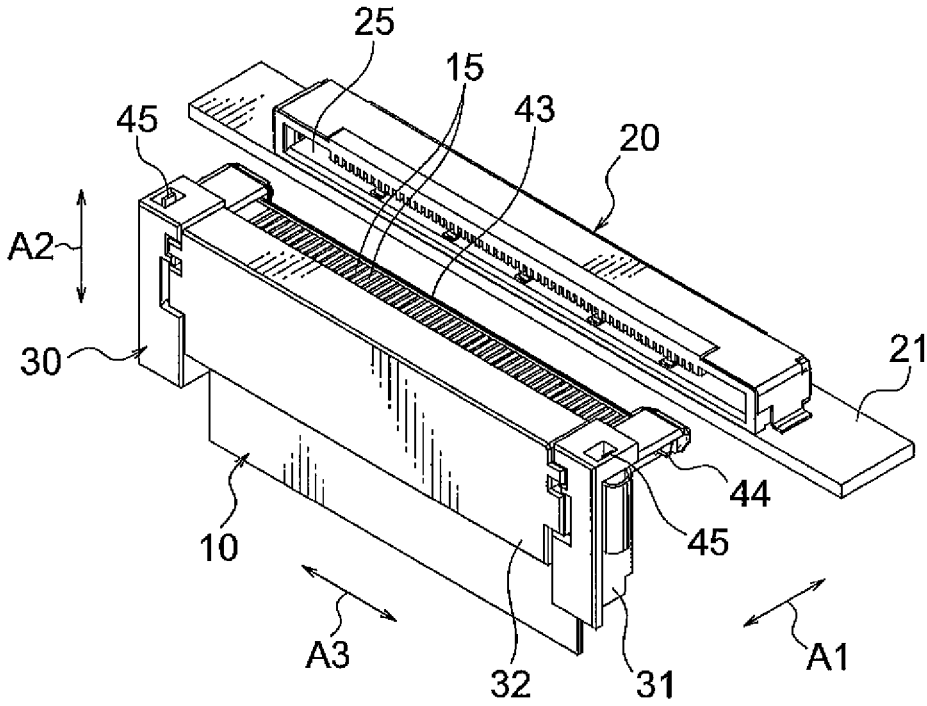
FIG. 3 is a perspective view showing an example of a connector set including a plug connector and a receptacle connector before those connectors are connected to each other.
Figure 4:
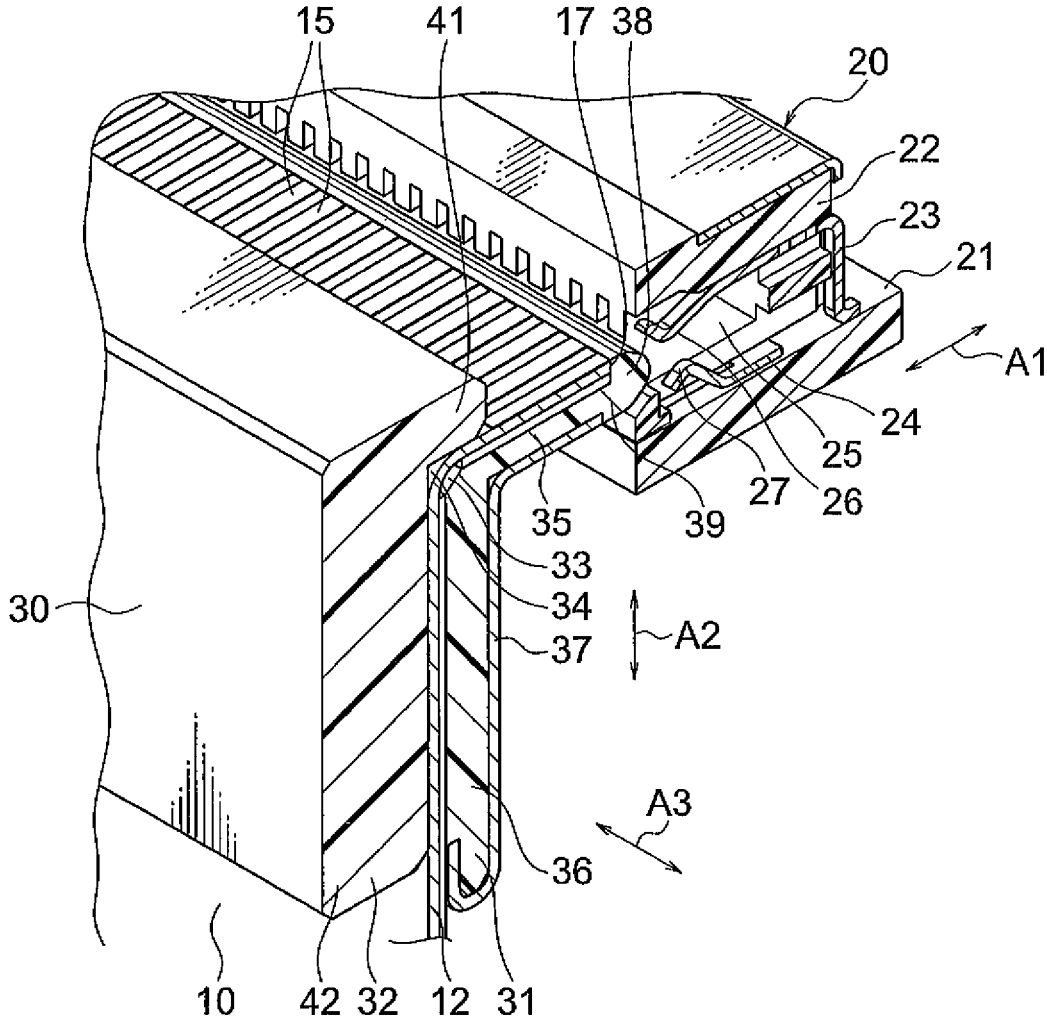
FIG. 4 is an enlarged perspective view, partially in cross-section, showing that the connectors of the connector set of FIG. 3 are being connected to each other.
Figure 5:
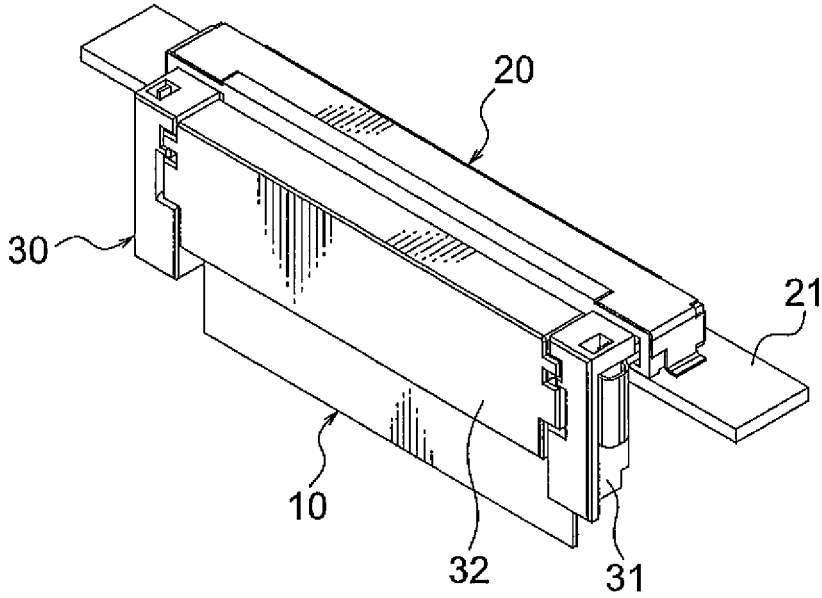
FIG. 5 is a perspective view showing an appearance of the connector set of FIG. 3 when connection of the connector set has been completed.

FIG. 3 shows a connector set including a receptacle connector 20 as a mating connector and a plug connector 30 as a connector according to the first embodiment of the present invention before those connectors are connected to each other. FIG. 4 shows the connector set when the connectors are being connected to each other. FIG. 5 shows the connector set when connection of the connector set has been completed.

The receptacle connector 20 is illustrated as being mounted on a circuit board 21. The receptacle connector 20 includes a receptacle connector housing 22 having an insulating property, a large number of signal contacts 23 mounted on the receptacle connector housing 22, and one or more ground contacts 24. The signal contacts 23 and the ground contacts 24 have a conductive property. The receptacle connector housing 22 has a mating groove 25 extending along the third direction A3. Each of the signal contacts 23 has a signal contact part 26. The signal contact parts 26 of the signal contacts 23 are arranged above the mating groove 25 and spaced from each other at the aforementioned pitch along the third direction A3. Each of the ground contacts 24 has at least one ground contact part 27 arranged below the mating groove 25.

The plug connector 30 includes the aforementioned connection member 10, a base 31, and a cover 32. The base 31 and the cover 32 sandwich the connection member 10 from both sides of the connection member 10 in cooperation with each other. The base 31 has a projecting surface 33 facing the bent portion 13 of the connection member 10. The cover 32 has a recessed surface 34 facing the bent portion 13 of the connection member 10. Thus, the shape of the connection member 10 is maintained by the base 31 having the projecting surface 33 and the cover 32 having the recessed surface 34.

The base 31 has a first receiver portion 35 in the form of a plate and a second receiver portion 36 in the form of a plate. The first receiver portion 35 extends along the first direction A1 and the third direction A3 on one side of the projecting surface 33. The second receiver portion 36 extends along the second direction A2 and the third direction A3 on the other side of the projecting surface 33. The first receiver portion 35 faces the first portion 11 of the connection member 10, whereas the second receiver portion 36 faces the second portion 12 of the connection member 10. In other words, the connection member 10 is arranged mostly on one side of the base 31. The base 31 has a conductive base ground 37 provided on the other side thereof. The first receiver portion 35 includes a first protector part 38 for covering and protecting the edge 17 of the first portion 11 of the connection member 10 and a second protector part 39 for covering and protecting an end of the base ground 37.

The cover 32 has a first presser portion 41 for pressing the first portion 11 of the connection member 10 on one side of the recessed surface 34 and a second presser portion 42 for pressing the second portion 12 of the connection member 10 on the other side of the recessed surface 34. The first presser portion 41 terminates at a location spaced from the first protector part 38 of the base 31. Therefore, the signal conductors 15 of the connection member 10 are outwardly exposed between the first presser portion 41 and the first protector part 38.

Thus, the plug connector 30 has a mating portion 43 formed by part of the connection member 10, part of the base 31, and part of the base ground 37. The contact parts of the signal conductors 15 of the connection member 10 are exposed on an upper surface of the mating portion 43 in a state in which they are spaced from each other at the aforementioned pitch along the third direction A3.

When the plug connector 30 is connected to the receptacle connector 20, the mating portion 43 is fitted into the mating groove 25. At that time, the contact parts of the signal conductors 15 are brought into contact with the signal contact parts 26 of the receptacle connector 20 in a one-to-one relationship. Meanwhile, the base ground 37 is brought into contact with the ground contact parts 27 of the receptacle connector 20. Thus, the plug connector 30 is electrically connected to the receptacle connector 20.

Since the first protector part 38, which covers the tip of the connection member 10, is provided on a tip end of the mating portion 43, the connection member 10 is prevented from being broken during a mating operation. In order to insert the mating portion 43 smoothly into between the signal contact parts 26 and the ground contact parts 27, it is preferable to chamfer one of or both of ends of the first protector part 38 and the second protector part 39.

As shown in FIG. 3, the base 31 has a pair of lock mechanisms 44 provided on both sides of the first receiver portion 35 in the third direction A3. The lock mechanisms 44 are inserted into the mating groove 25 of the receptacle connector 20 along with the mating portion 43 when the plug connector 30 is being connected to the receptacle connector 20. The lock mechanisms 44 are clicked to engage with the receptacle connector housing 22 in the first direction A1. As a result, connection between the receptacle connector 20 and the plug connector 30 is locked. As shown in FIG. 3, it is preferable to form operation holes 45 in an upper surface of the base 31 so that the lock mechanisms 44 can be unlocked.

Referring to FIGS. 6A to 9, a method of assembling the plug connector 30 will be described along with the detailed structure of the plug connector 30.

Figure 6A:
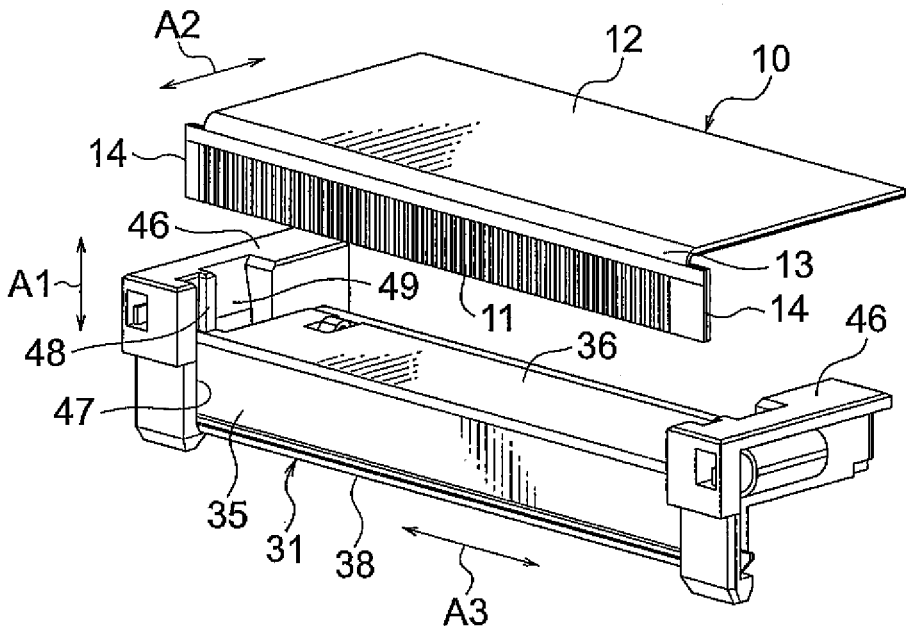
FIGS. 6A and 6B are perspective views explanatory of a first step of assembling the plug connector of the connector set shown in FIG. 3.
Figure 6B:
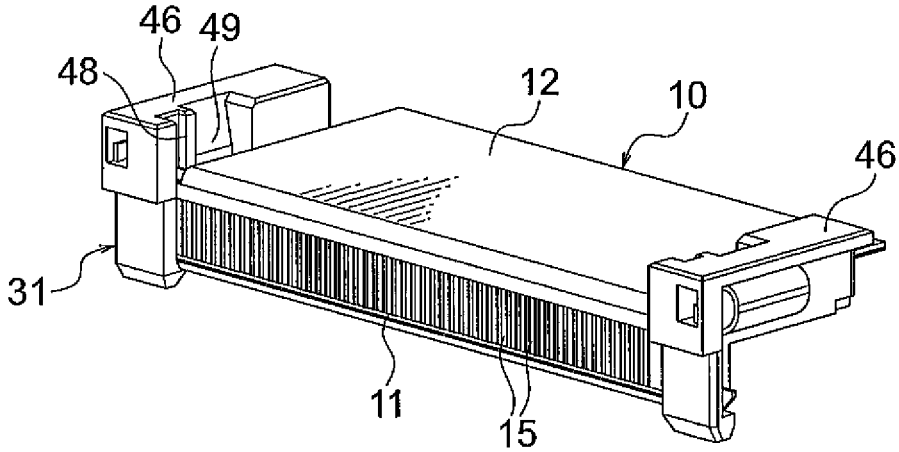

In a first step of assembling the plug connector 30, the connection member 10 and the base 31 are prepared as shown in FIG. 6A. The base 31 has a pair of wall portions 46 provided on both ends of thereof in the third direction A3. Each of the wall portions 46 has an ear portion guide 47 formed near the first receiver portion 35, more specifically, outside of an outer edge of the first receiver portion 35. The ear portion guides 47 of the wall portions 46 are opposed to each other. Each of the ear portion guides 47 extends along the first direction A1. Each of the ear portion guides 47 is formed by a groove as illustrated in FIG. 6A. Then, as shown in FIG. 6B, the connection member 10 is mounted between the wall portions 46. When the connection member 10 is being mounted, the ear portions 14 of the connection member 10 are inserted into the ear portion guides 47 of the base 31. Thus, the first portion 11 of the connection member 10 faces an outside surface of the first receiver portion 35 of the base 31, and the second portion 12 of the connection member 10 faces an upper surface of the second receiver portion 36 of the base 31. Furthermore, the signal conductors 15 are exposed outwardly on the first portion 11 of the connection member 10.

Figure 7:
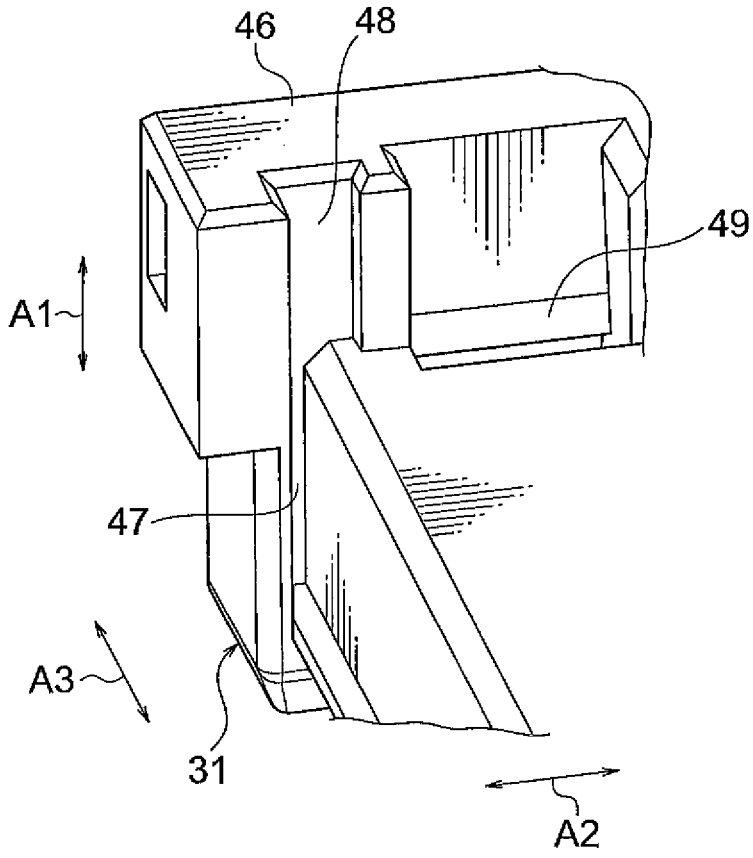
FIG. 7 is an enlarged view showing part of FIG. 6A as viewed from another angle.

As can be seen from FIGS. 6B and 7, a pair of guide grooves 48 extending along the first direction A1 as with the ear portion guides 47 are formed in the wall portions 46 of the base 31 so that they are opposed to each other in the third direction A3. A pair of cover attachment portions 49 are formed adjacent to the guide grooves 48 in the wall portions 46 of the base 31 so that they are opposed to each other in the third direction A3.

Figure 8A:
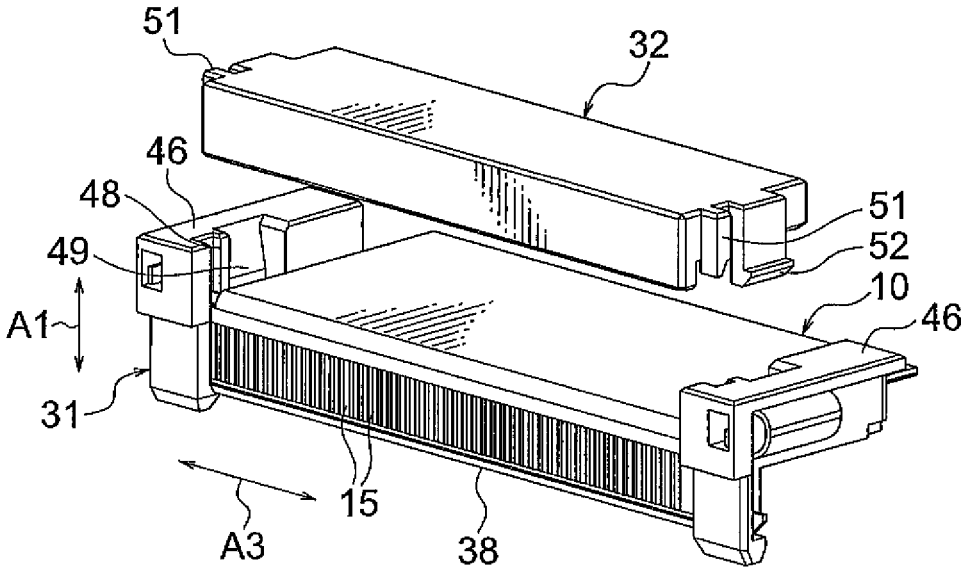
FIGS. 8A and 8B are perspective views explanatory of a second step of assembling the plug connector of the connector set shown in FIG. 3.
Figure 8B:
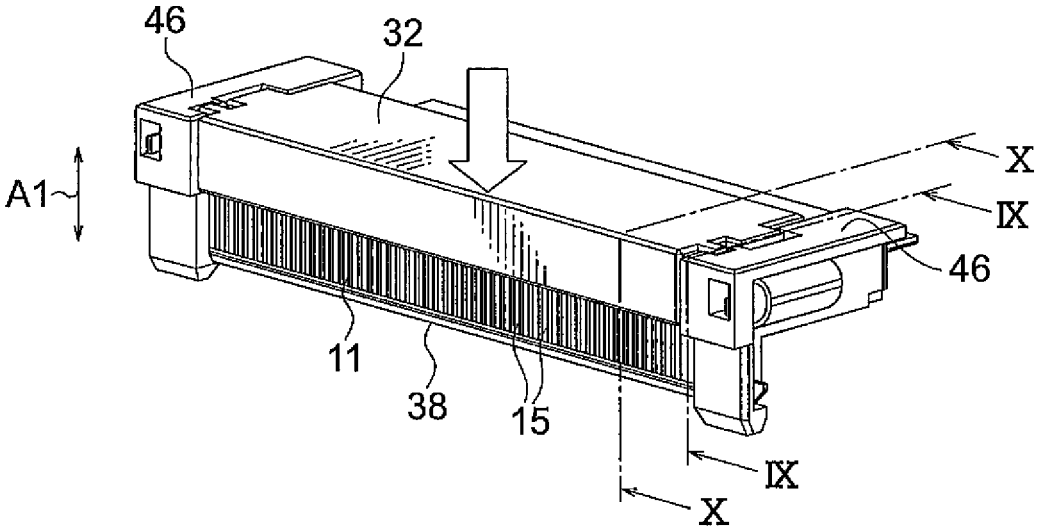

In a second step of assembling the plug connector 30, the cover 32 is prepared as shown in FIG. 8A. The cover 32 has guide protrusions 51 and engagement portions 52 provided on both ends of the cover 32 in the third direction A3. As shown in FIG. 8B, the cover 32 is mounted between the wall portions 46. When the cover 32 is being mounted, the guide protrusions 51 of the cover 32 are inserted into the guide grooves 48 of the base 31. The guide protrusions 51 slide within the guide grooves 48 in the first direction A1, so that the guide grooves 48 guide the guide protrusions 51 for mounting the cover 32. The guide protrusions 51 and the guide grooves 48 jointly serve as a guide mechanism.

When the cover 32 is mounted into the base 31 until the cover 32 is brought into contact with the connection member 10, the engagement portions 52 engage with the cover attachment portions 49 of the base 31 in the first direction A1. Thus, detachment of the cover 32 from the base 31 is prevented.

Figure 9:
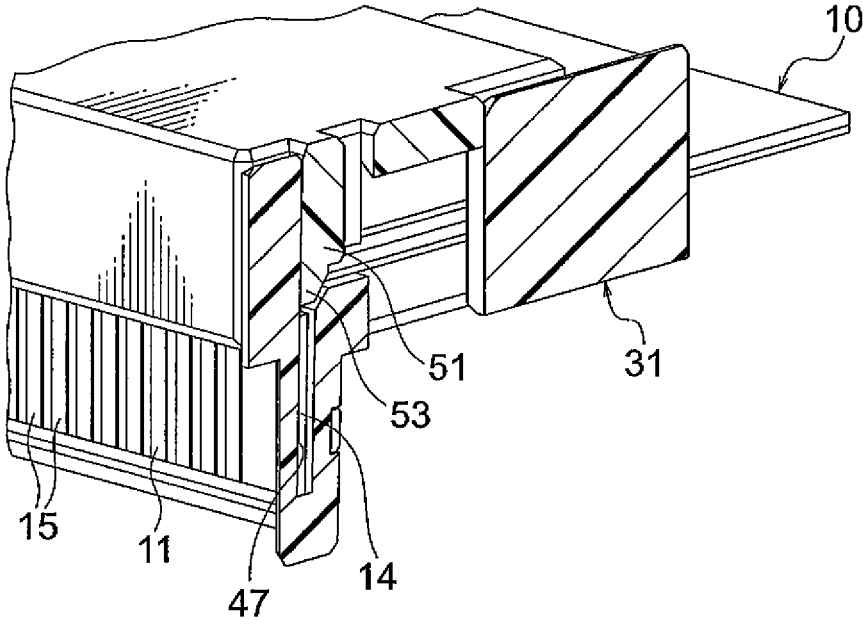
FIG. 9 is an enlarged perspective view with a cross-section taken along line IX-IX of FIG. 8B.

As shown in FIG. 9, an actuator portion 53 is provided on an end of each of the guide protrusions 51. When the assembly of the plug connector 30 has been completed, the actuator portion 53 is positioned at an end of the ear portion guide 47 in the first direction A1. As a result, the actuator portion 53 abuts an edge of the ear portion 14 of the connection member 10 in the first direction A1. Therefore, both ends of the cover 32 push the ear portions 14 of the connection member 10 during a mating operation, so that a force is applied directly to the connection member 10 in the mating direction. Accordingly, a contact failure can be prevented from occurring due to deformation of the tip of the connection member 10.

Figure 10A:
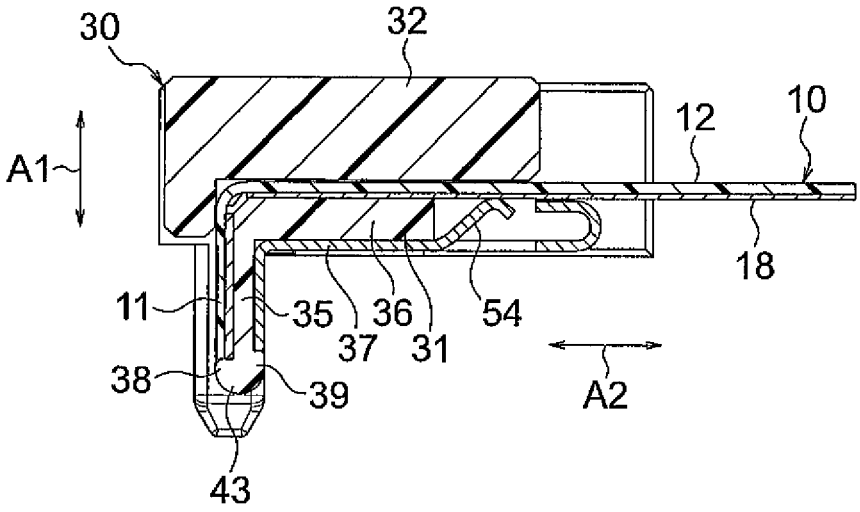
FIG. 10A is a cross-sectional view taken along line X-X of FIG. 8B.
Figure 10B:
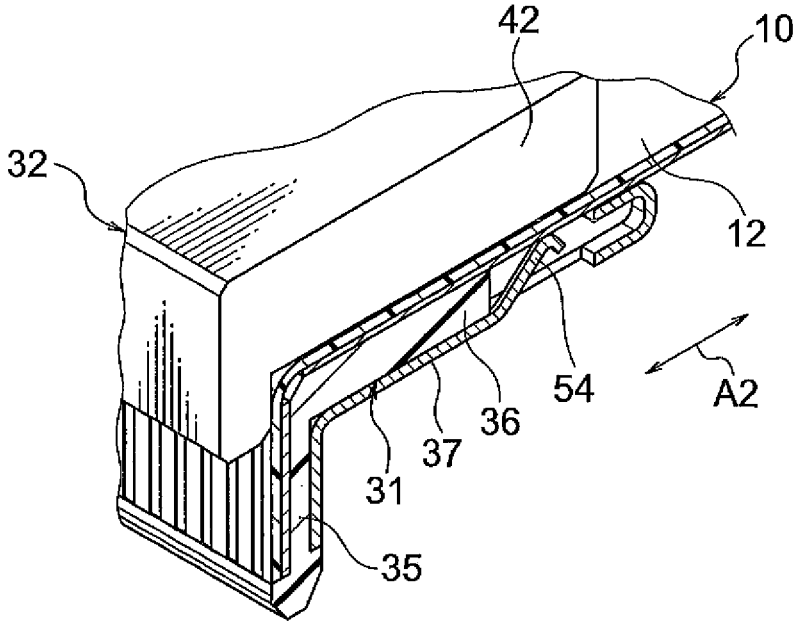
FIG. 10B is an enlarged perspective view with a cross-section taken along line X-X of FIG. 8B.

Furthermore, as shown in FIGS. 10A and 10B, the base ground 37 has a spring 54 extending through the base 31. The spring 54 is held in contact with the ground conductors 18 of the connection member 10 under pressure. As a result, the spring 54 presses the second portion 12 of the connection member 10 toward the second presser portion 42 of the cover 32. Therefore, the second portion 12 of the connection member 10 abuts the second presser portion 42 of the cover 32. The second portion 12 of the connection member 10 may be held in contact with the second receiver portion 36 of the base 31 or may be spaced from the second receiver portion 36 in a floated manner depending upon a manufacturing tolerance or the like.

At that time, the spring 54 is positioned on a side of the cover attachment portions 49 of the base 31 (see FIGS. 6A to 8B) that is opposite to the first portion 11 of the connection member 10 in the second direction A2. In other words, the cover attachment portions 49 are positioned between the first portion 11 and the spring 54. As a result, when the connection member 10 is pressed by the spring 54, a moment is produced around the cover attachment portions 49. The connection member 10, particularly the first portion 11, is pressed against the outside surface of the first receiver portion 35 of the base 31 by this moment. Therefore, the first portion 11, particularly the tip of the first portion 11, is held in abutment against the base 31. Accordingly, the first portion 11 is prevented from being deformed by an external force when the connectors are being mated with and connected to each other. Thus, a contact failure is unlikely to occur.

Next, a second embodiment of the present invention will be described with reference to FIGS. 11 to 17. Portions having the same function as shown in FIGS. 2A to 10B are denoted by the same reference numerals, and a further explanation is omitted herein.

Figure 11:
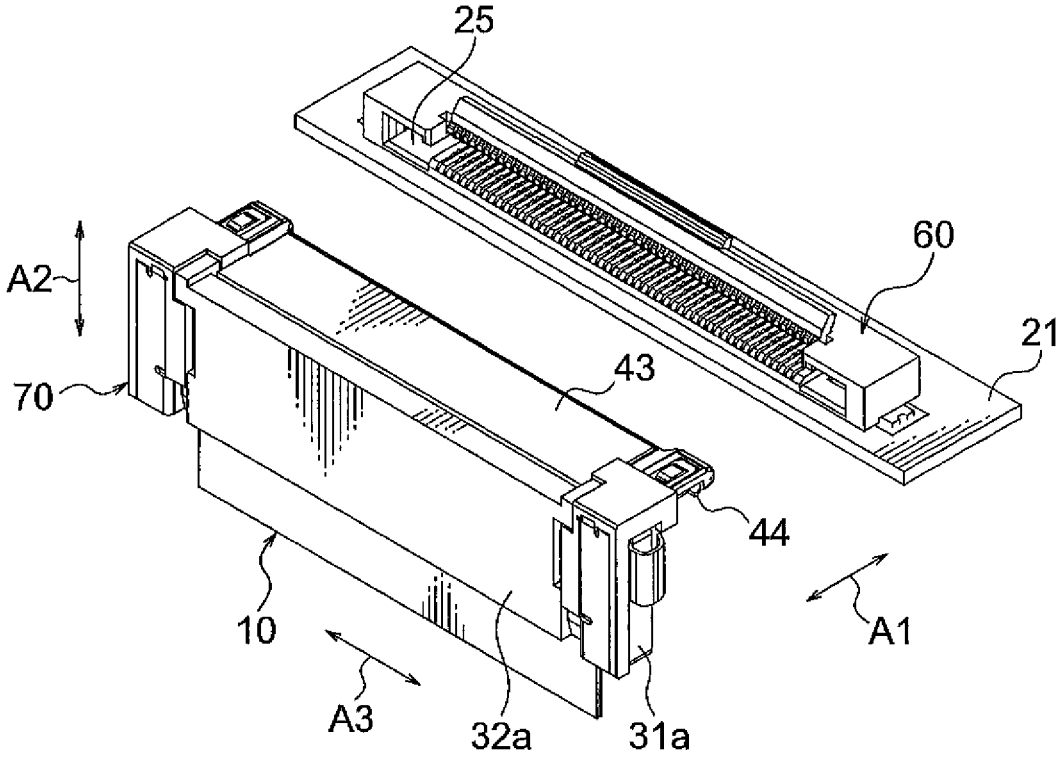
FIG. 11 is a perspective view showing another example of a connector set including a plug connector and a receptacle connector before those connectors are connected to each other.
Figure 12:
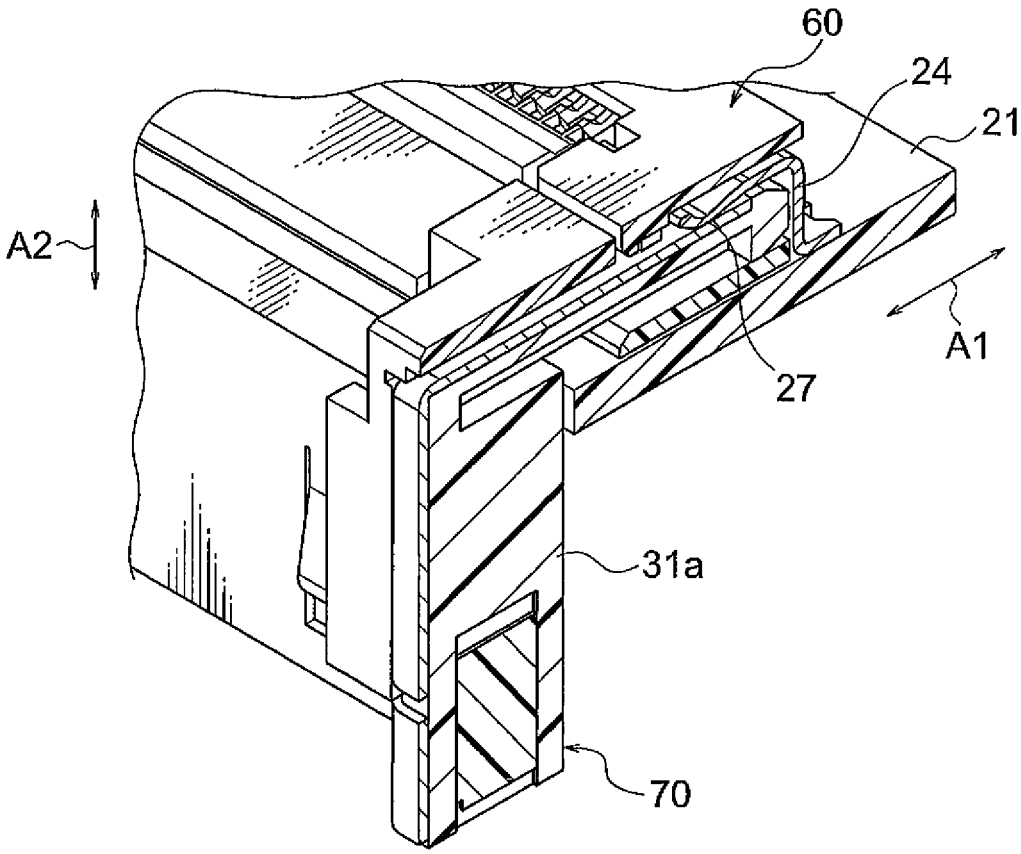
FIG. 12 is an enlarged perspective view with a cross-section showing part of an internal structure of the connector set shown in FIG. 11 when connection of the connector set has been completed.
Figure 13:
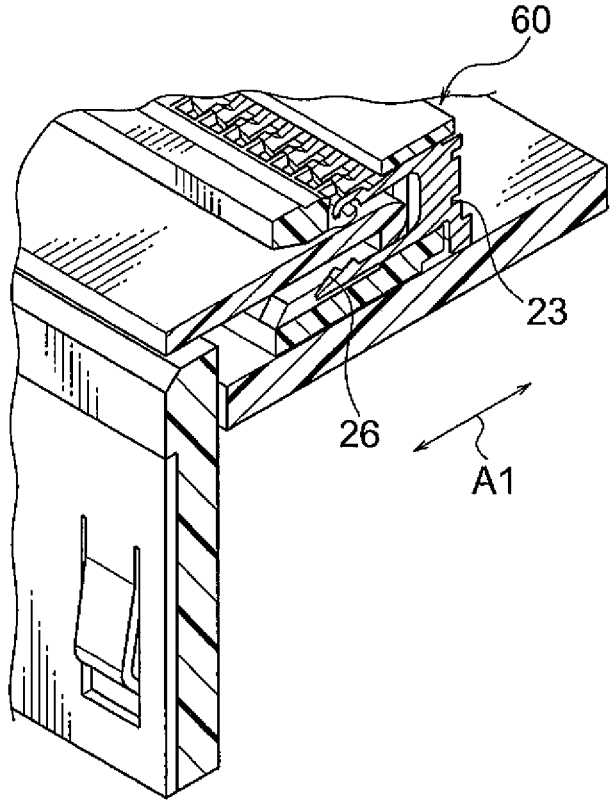
FIG. 13 is an enlarged perspective view with a cross-section showing another part of the internal structure of the connector set shown in FIG. 11 when connection of the connector set has been completed.

FIG. 11 shows a connector set including a receptacle connector 60 as a mating connector and a plug connector 70 as a connector according to a second embodiment of the present invention before those connectors are connected to each other. FIG. 12 shows part of an internal structure of the connector set shown in FIG. 11 when connection of the connector set has been completed. FIG. 13 shows another part of the internal structure of the connector set shown in FIG. 11 when connection of the connector set has been completed.

In the receptacle connector 60 of this connector set, the signal contact parts 26 of the signal contacts 23 are arranged below the mating groove 25 and spaced from each other at the aforementioned pitch along the third direction A3. Meanwhile, each of the ground contacts 24 has at least one ground contact part 27 arranged above the mating groove 25. Thus, the positional relationship between the signal contact parts 26 and the ground contact parts 27 of the receptacle connector 60 is vertically inverse to that of the aforementioned receptacle connector 20. Accordingly, the plug connector 70 has been modified from the aforementioned plug connector 30 such as to conform to the receptacle connector 60.

Referring to FIGS. 14A to 17, some changes from the aforementioned plug connector 30 will mainly be described along with a method of assembling the plug connector 70. Portions that are not described have the same configuration and function as in the aforementioned plug connector 30.

Figure 14A:
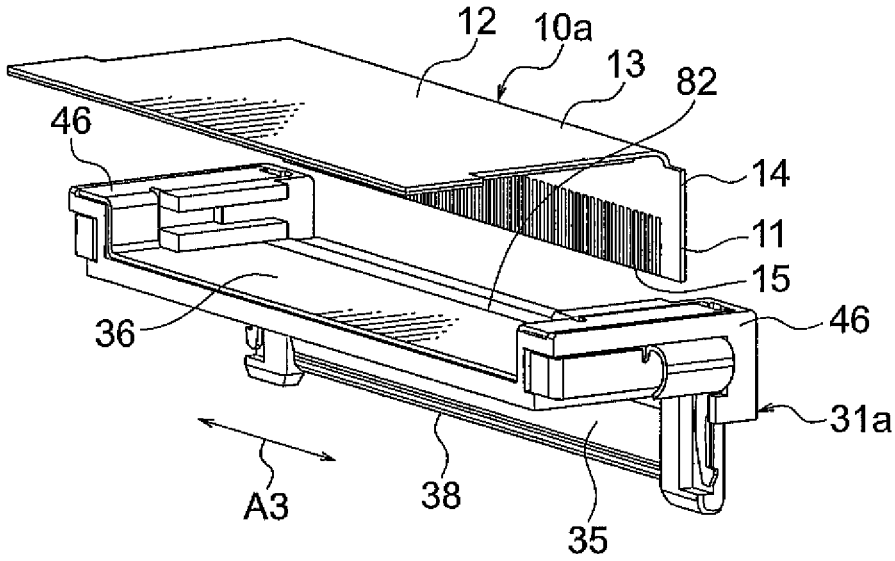
FIGS. 14A and 14B are perspective views explanatory of a first step of assembling the plug connector of the connector set shown in FIG. 11.

In a first step of assembling the plug connector 70, a connection member 10*a* and a base 31*a* are prepared as shown in FIG. 14A.

The connection member 10*a* differs from the connection member 10 shown in FIGS. 2A and 2B in the following points: Specifically, a large number of signal conductors 15 are exposed outwardly on an inside surface of a first portion 11 of the connection member 10*a*, which corresponds to a right side surface of the first portion 11 shown in FIG. 2B. Those signal conductors 15 constitute contact parts that are brought into contact with a mating contact parts when the connection member 10*a* is mated with and connected to the mating connector.

A reinforcement plate (not shown) having the same function and shape as the reinforcement plate 16 shown in FIG. 2B is attached to an outside surface of the first portion 11 and the ear portions 14, which corresponds to a left side surface of the first portion 11 shown in FIG. 2B. Such a reinforcement plate has an insulating property. Therefore, a tip of the first portion 11 of the connection member 10*a* is reinforced with the reinforcement plate, so that it is unlikely to be bent. Accordingly, the first portion 11 is not deformed even if some external forces are applied to the first portion 11.

This connection member 10*a* has the same configuration as the connection member 10 shown in FIG. 2 in the following points: The signal conductors 15 are arranged at a predetermined pitch along the third direction A3. The signal conductors 15 continuously extend from the first portion 11 through the bent portion 13 to the second portion 12.

Furthermore, the ear portions 14 for increasing the size of the connection member 10*a* are provided on a portion of the first portion 11 that is located near the bent portion 13. Therefore, the bent portion 13 can be formed by bending the connection member 10*a* while using the ear portions 14 as a base. Accordingly, the accuracy of a bending point of the connection member 10*a*, i.e., the accuracy of a location of the bent portion 13, can be enhanced so that a certain effective contact length can readily be obtained.

Figure 15:
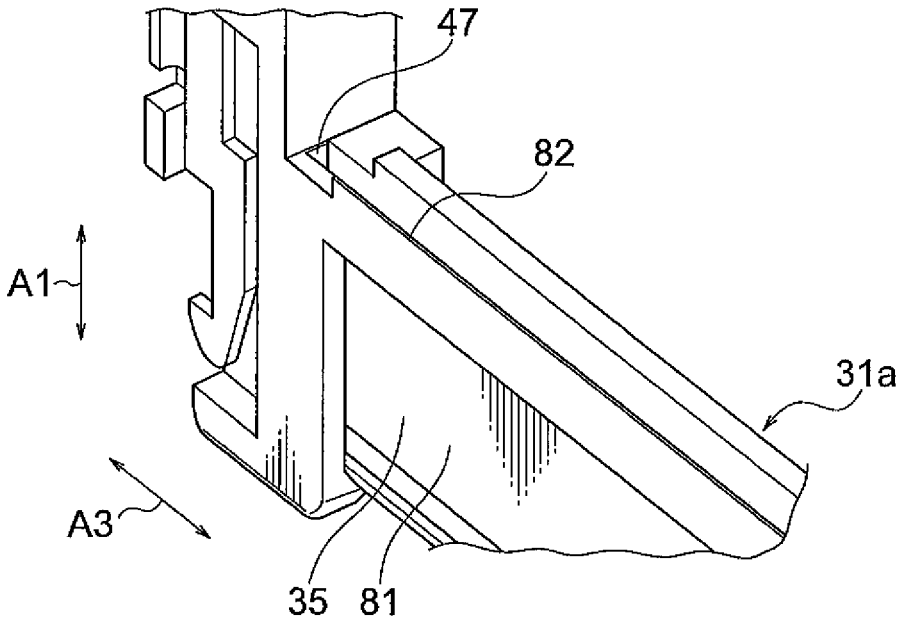
FIG. 15 is an enlarged view showing part of FIG. 14A as viewed from another angle.

Meanwhile, a pair of ear portion guides 47 is formed in a pair of wall portions 46 of a base 31*a* (see FIG. 15). The ear portion guides 47 extend along the first direction A1 on an inside surface 81 of the first receiver portion 35. Furthermore, a slit 82 is formed between the first receiver portion 35 and the second receiver portion 36. The slit 82 extends along the third direction A3 so as to connect the ear portion guides 47 to each other.

Figure 14B:
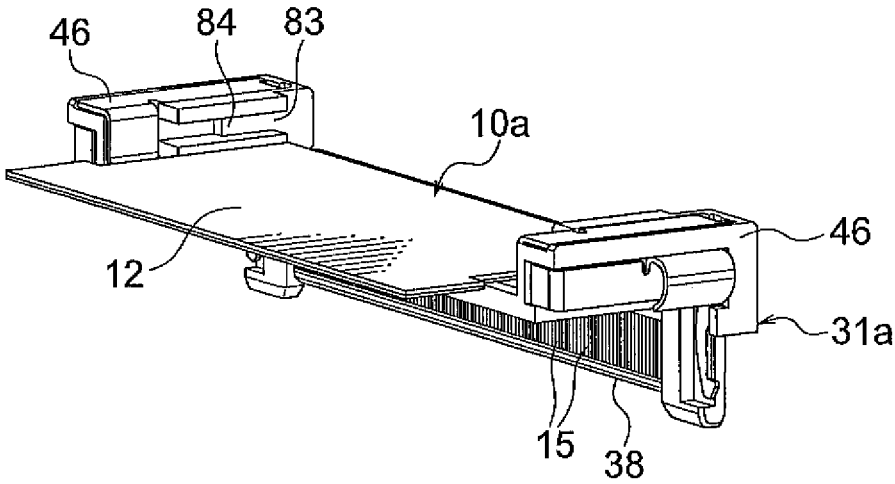

Then, as shown in FIG. 14B, the connection member 10*a* is mounted between the wall portions 46. When the connection member 10*a* is being mounted, the first portion 11 of the connection member 10*a* is inserted into the slit 82 (see FIG. 15), and the ear portions 14 of the connection member 10*a* are inserted into the ear portion guides 47 of the base 31*a*. Thus, the first portion 11 of the connection member 10*a* faces the inside surface 81 of the first receiver portion 35 of the base 31*a*, and the second portion 12 of the connection member 10*a* faces an upper surface of the second receiver portion 36 of the base 31*a*. Furthermore, the signal conductors 15 are exposed inwardly on the first portion 11 of the connection member 10*a*.

As shown in FIG. 14B, each of the wall portions 46 of the base 31*a* has a guide groove 83 extending along the second direction A2 and a cover attachment portion 84 formed in the guide groove 83. The guide grooves 83 of the wall portions 46 are opposed to each other in the third direction A3. The cover attachment portions 84 of the wall portions 46 are opposed to each other in the third direction A3.

Figure 16A:
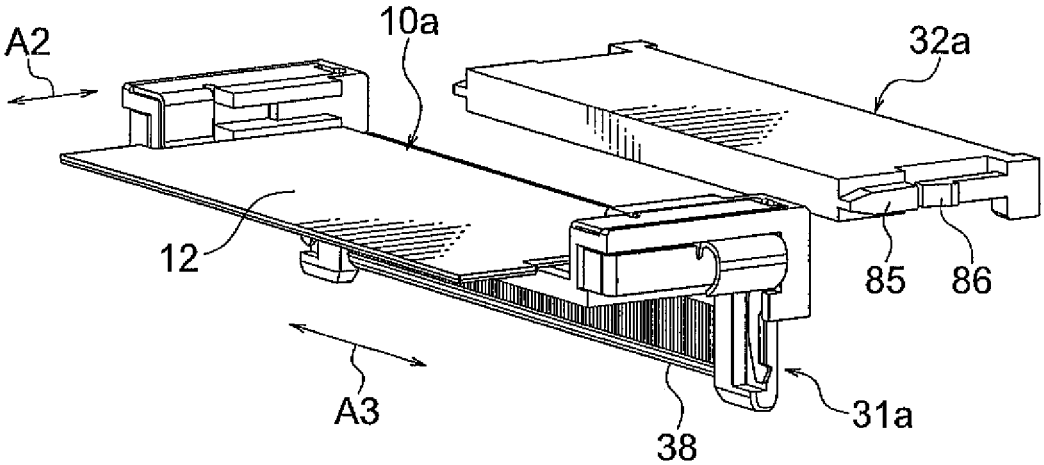
FIGS. 16A and 16B are perspective views explanatory of a second step of assembling the plug connector of the connector set shown in FIG. 11.
Figure 16B:
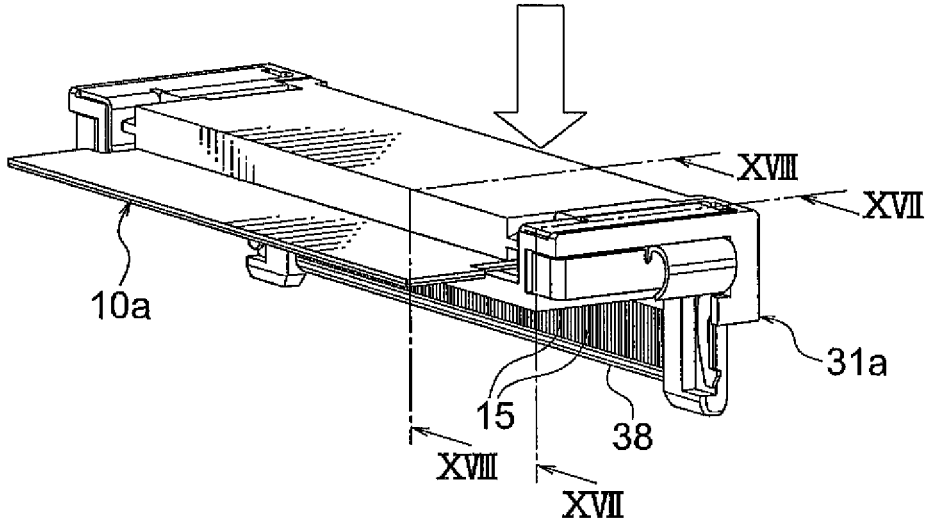

In a second step of assembling the plug connector 70, a cover 32*a* is prepared as shown in FIG. 16A. The cover 32*a* has guide protrusions 85 and engagement portions 86 provided on both ends of the cover 32*a* in the third direction A3. The cover 32*a* is moved along the second portion 12 of the connection member 10*a* in the second direction A2 and inserted into between the wall portions 46. When the cover 32*a* is being mounted, the guide protrusions 85 of the cover 32*a* are inserted into the guide grooves 83 of the base 31. The guide protrusions 85 slide in the second direction A2, so that the guide grooves 83 guide the guide protrusions 85 for mounting the cover 32*a*. The guide protrusions 85 and the guide grooves 83 jointly serve as a guide mechanism.

When the cover 32*a* is mounted into a predetermined position, the engagement portions 86 engage with the cover attachment portions 84 in the second direction A2. Thus, detachment of the cover 32*a* from the base 31*a* is prevented.

Figure 17:
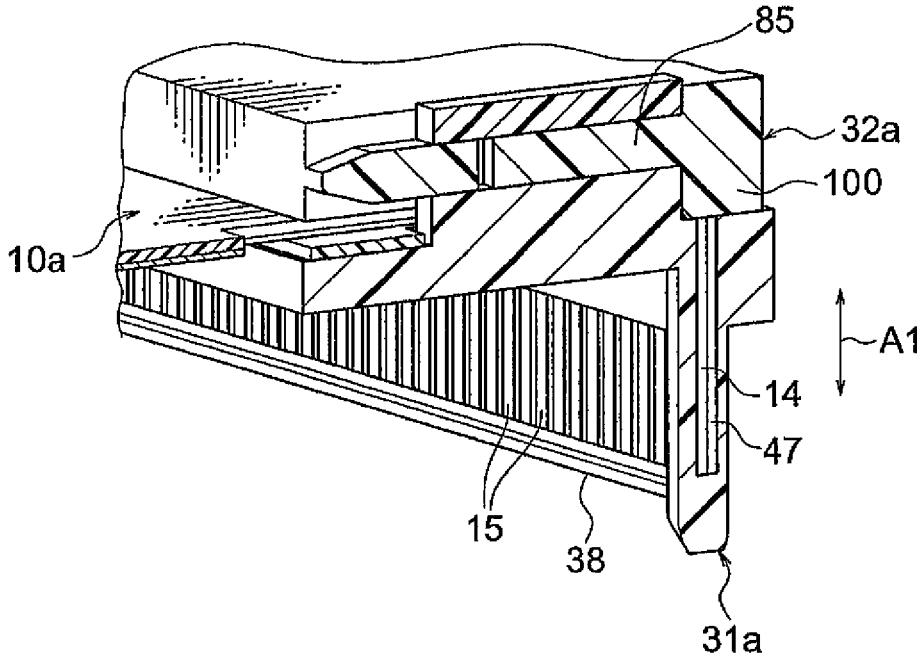
FIG. 17 is an enlarged perspective view with a cross-section taken along line XVII-XVII of FIG. 16B.

As shown in FIG. 17, an actuator portion 100 is provided on an end of each of the guide protrusions 85. When the assembly of the plug connector 70 has been completed, the actuator portion 86 is positioned at an end of the ear portion guide 47 in the first direction A1. As a result, the actuator portion 100 abuts an edge of the ear portion 14 of the connection member 10*a* in the first direction A1. Therefore, both ends of the cover 32*a* push the ear portions 14 of the connection member 10*a* during a mating operation, so that a force is applied directly to the connection member 10*a* in the mating direction. Accordingly, a contact failure can be prevented from occurring due to deformation of the tip of the connection member 10*a*.

Figure 18:
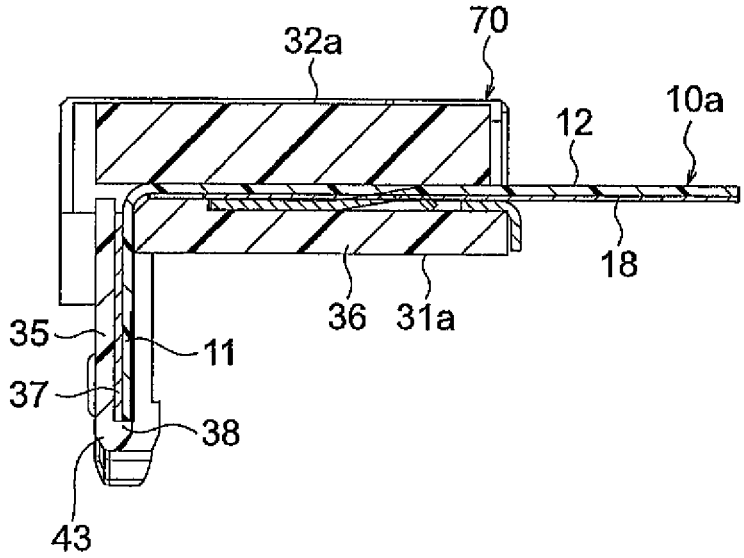
FIG. 18 is a cross-sectional view taken along line XVIII-XVIII of FIG. 16B.

Furthermore, as shown in FIG. 18, a first protector part 38 for covering an end of the base ground 37 and an end of the connection member 10*a* is provided at a tip end of the mating portion 43. Therefore, the base ground 37 and the connection member 10*a* are prevented from being broken during a mating operation. As a matter of course, it is preferable to chamfer tip surfaces of the first protector part 38 in order to insert the mating portion 43 smoothly into between the signal contact parts 26 and the ground contact parts 27.

Moreover, it is preferable to provide the cover 32*a* with a spring having the same function as the spring 54 described in the first embodiment of the present invention. Such a spring provides a moment to the connection member 10*a*. The connection member 10*a*, particularly the first portion 11, is pressed against the base ground 37 by this moment. In such a case, the first portion 11, particularly the tip of the first portion 11, is held in abutment against the base ground 37. Accordingly, the first portion 11 is prevented from being deformed by an external force when the connectors are being mated with and connected to each other. Thus, a contact failure is unlikely to occur.

This invention is not limited to the above-mentioned embodiment and part or the whole thereof can also be described as the following supplementary notes but is not limited thereto.

(Supplementary Note 1)

A connector 30, 70 to be connected to a mating connector 20, 60 with being fitted into the mating connector in a first direction A1, the connector comprising:

a connection member 10, 10*a* which is of a plate-like or a sheet-like and has flexibility;

a base 31, 31*a*; and a cover 32, 32*a* which is cooperated with the base to sandwich the connection member from both sides thereof, the connection member including:

a first portion 11 which extends in the first direction for being connected to the mating connector;

a second portion 12 which extends in a second direction A2 crossing the first direction;

a bent portion 13 which is between the first portion and the second portion; and an ear portion 14 which is provided on at least portion of the first portion to increase a size of the connection member in a third direction A3 perpendicular to the first and the second directions, the at least portion being adjacent to the bent portion, the cover including an actuator portion 53, 100 which presses an edge of the ear portion in the first direction during an operation of mating the connector to the mating connector.

With this connector, a certain effective contact length is ensured by bending the connection member while using the ear portion as a base. Therefore, occurrence of a contact failure can be reduced. Furthermore, the first portion of the connection member can readily be fitted into the mating connector during a mating operation because the actuator portion provided on the cover abuts an edge of the ear portion.

Moreover, a protector part covering a tip of the connection member may be provided on a tip end of the mating portion.

With this protector part, the connection member is prevented from colliding directly with the mating connector.

(Supplementary Note 2)

The connector according to supplementary note 1, further comprising a spring 54 for pressing the second portion toward the cover.

(Supplementary Note 3)

The connector according to supplementary note 2, wherein the base and the cover are connected to each other at a location between the first portion and the spring.

(Supplementary Note 4)

The connector according to supplementary note 2 or 3, wherein:

the base includes a conductive base ground; and the spring is provided on the base ground.

(Supplementary Note 5)

The connector according to any one of supplementary notes 2-4, wherein:

the second portion includes a ground conductor 18 opposed to the base in the first direction; and the spring is held in contact with the ground conductor under pressure.

(Supplementary Note 6)

The connector according to any one of supplementary notes 1-5, further comprising a reinforcement plate 16 attached to at least part of the first portion, the at least part being located near an edge of the first portion on an opposite side of the second portion in the first direction.

(Supplementary Note 7)

The connector according to any one of supplementary notes 1-6, wherein:

the base includes a receiver portion 35 facing the first portion; and the receiver portion includes a protector part 38 covering a free end of the first portion in the first direction.

Thus, when the protector part covering a tip of the connection member is provided on a tip end of the mating portion, the connection member is prevented from colliding directly with the mating connector.

(Supplementary Note 8)

The connector according to supplementary note 7, wherein the connection member includes a signal conductor 15 continuously extending on the first portion, the bent portion, and the second portion, and the signal conductor includes a contact part that is exposed outwardly between the protector part and the cover and is brought into contact with the mating connector when the connectors are mated with and connected to each other.

(Supplementary Note 9)

The connector according to any one of supplementary notes 1-8, wherein:

the base includes an ear portion guide 47 extending along the first direction for receiving the ear portion; and the actuator portion is located on an end of the ear portion guide.

(Supplementary Note 10)

The connector according to supplementary note 9, wherein: the base comprises a cover attachment portion 49, 84 for attachment of the cover; and the cover attachment portion being located between the first portion and the spring.

(Supplementary Note 11)

The connector according to supplementary note 9 or 10, further comprising a guide mechanism 48, 51 for guiding the cover relative to the base in the first direction, wherein the cover includes an engagement portion 52 for engaging with the cover attachment portion in the first direction to prevent detachment of the cover from the base.

(Supplementary Note 12)

The connector according to supplementary note 9 or 10, further comprising a guide mechanism 83, 85 for guiding the cover relative to the base in the second direction, wherein the cover includes an engagement portion 86 for engaging with the cover attachment portion in the second direction to prevent detachment of the cover from the base.

(Supplementary Note 13)

The connector according to any one of supplementary notes 1-12, wherein the base includes a lock mechanism 44 provided on both ends of the base in the third direction for mechanically locking a connection with the mating connector.

While the invention has been particularly shown and described with reference to exemplary embodiments thereof, the invention is not limited to these embodiments, It will be understood by those of ordinary skill in the art that various changes in form and details may be made therein without departing from the spirit and scope of the present invention as defined by the claims.

What is claimed is:

1. A connector to be connected to a mating connector with being fitted into the mating connector in a first direction, the connector comprising:

a connection member which is of a plate-like or a sheet-like and has flexibility;

a base; and a cover which is cooperated with the base to sandwich the connection member from both sides thereof;

the connection member including:

a first portion which extends in the first direction for being connected to the mating connector;

a second portion which extends in a second direction crossing the first direction;

a bent portion which is between the first portion and the second portion; and an ear portion which is provided on at least portion of the first portion to increase a size of the connection member in a third direction perpendicular to the first and the second directions, the at least portion being adjacent to the bent portion, the cover including an actuator portion which presses an edge of the ear portion in the first direction during an operation of mating the connector to the mating connector.

2. The connector according to claim 1, further comprising a spring for pressing the second portion toward the cover.

3. The connector according to claim 2, wherein:

the base includes a conductive base ground; and the spring is provided on the base ground.

4. The connector according to claim 2, wherein:

the second portion includes a ground conductor opposed to the base in the first direction; and the spring is held in contact with the ground conductor under pressure.

5. The connector according to claim 1, further comprising a reinforcement plate attached to at least part of the first portion, the at least part being located near an edge of the first portion on an opposite side of the second portion in the first direction.

6. The connector according to claim 1, wherein:

the base includes a receiver portion facing the first portion; and the receiver portion includes a protector part covering a free end of the first portion in the first direction.

7. The connector according to claim 1, wherein:

the base includes an ear portion guide extending along the first direction for receiving the ear portion; and the actuator portion is located on an end of the ear portion guide.

8. The connector according to claim 7, further comprising a spring for pressing the second portion toward the cover, wherein:

the base comprises a cover attachment portion for attachment of the cover; and the cover attachment portion being located between the first portion and the spring.

9. The connector according to claim 8, further comprising a guide mechanism for guiding the cover relative to the base in the first direction, wherein the cover includes an engagement portion for engaging with the cover attachment portion in the first direction to prevent detachment of the cover from the base.

10. The connector according to claim 8, further comprising a guide mechanism for guiding the cover relative to the base in the second direction, wherein the cover includes an engagement portion for engaging with the cover attachment portion in the second direction to prevent detachment of the cover from the base.

11. The connector according to claim 1, wherein the base includes a lock mechanism provided on both ends of the base in the third direction for mechanically locking a connection with the mating connector.

* * * * *